US005265346A

United States Patent [19]

Jikumaru et al.

[11] Patent Number: 5,265,346

[45] Date of Patent: Nov. 30, 1993

[54] DRYING CARRIER ADAPTED FOR CARRYING HONEYCOMB STRUCTURE

[75] Inventors: Sueharu Jikumaru, Kasugai; Yukihisa Wada, Aichi, both of Japan

[73] Assignee: NGK Insulators, Ltd., Japan

[21] Appl. No.: 858,067

[22] Filed: Mar. 26, 1992

[30] Foreign Application Priority Data

Mar. 26, 1991 [JP] Japan ..... 3-84568

[51] Int. Cl.[5] ..... F26B 23/08

[52] U.S. Cl. ..... 34/1 J; 34/68; 34/105

[58] Field of Search ..... 34/105, 236, 1 J, 1 E, 34/216, 217, 68, 203, 204; 264/57, 58

[56] References Cited

U.S. PATENT DOCUMENTS

| | | | |
|---|---|---|---|
| 4,053,993 | 10/1977 | Schregenberger | 34/105 |
| 4,439,929 | 4/1984 | Kitagawa et al. | 34/1 J |
| 4,492,571 | 1/1985 | Miura | 34/105 |
| 4,837,943 | 6/1989 | Mizutani | 34/1 E |

FOREIGN PATENT DOCUMENTS

| | | |
|---|---|---|
| 273707 | 7/1988 | European Pat. Off. . |
| 1482078 | 3/1966 | France . |
| 2071636 | 9/1971 | France . |
| 2652410 | 3/1991 | France . |
| 60-37382 | 8/1985 | Japan . |
| 8005219 | 3/1981 | Netherlands . |

*Primary Examiner*—Henry A. Bennett
*Assistant Examiner*—Denise L. F. Gromada
*Attorney, Agent, or Firm*—Parkhurst, Wendel & Rossi

[57] ABSTRACT

A drying carrier adapted for carrying honeycomb structures includes a plurality of perforated plates spaced to each other in the longitudinal direction of the drying carrier and made of a material having a conductivity higher than that of the drying carrier. Each of said perforated plates is provided with a convex portion having an upper contacting surface to be contacted with the bottom surface of the honeycomb structure to be carried. The surface area (A) of the upper contacting surface of the convex portion is smaller than the bottom surface area of the honeycomb structure.

9 Claims, 8 Drawing Sheets

DRYING CARRIER ADAPTED FOR CARRYING HONEYCOMB STRUCTURE

BACKGROUND OF THE INVENTION

This invention relates to a drying carrier adapted for carrying honeycomb structures.

Such a drying carrier may be used when the honeycomb structures are dried through a drying apparatus as shown in FIG. 1 which illustrates a dielectric and ventilation type drying apparatus including a dielectric drying zone 101 and a ventilation drying zone 102. In drying the honeycomb structure, the honeycomb structures 3 are carried on a carrier 1 in such a manner that the open bottom surface of the honeycomb structure 3 contacts the upper surface of the carrier 1. The honeycomb structure 3 is a ceramic green structure which is extrusion molded from a batch of a ceramic material through an extrusion die and has number of parallel through holes separated by partitions having a uniform thickness.

The honeycomb structures 3 carried on the carrier 1 are continuously moved through the dielectric drying zone 101 and the ventilation drying zone 102 by means of a dielectric drying conveyor 111 and a ventilation drying conveyor 112 and dried in this moving step.

The dielectric drying zone 101 includes upper and lower electrodes 113 which are arranged in parallel to the open end surfaces of the honeycomb structure and hot air ventilating ducts 114 for blowing hot air into the drying zone to prevent steam generated during drying from condemning on the surfaces of the electrodes 113 or the drying zone 101.

The honeycomb structures 3 are then transferred to the ventilation drying zone 102 by means of a ventilation drying conveyor 112 in order to completely dry the honeycomb structures after dielectric drying. In the ventilation drying zone 102, hot air of 80°~150° C. is blown at a speed 0.3~2.0 m/sec into the ventilation drying zone by means of hot air ventilating ducts 115 to dry the honeycomb structures 3 by ventilating.

Thus, the honeycomb structures 3 are subjected to a sequence of dielectric drying and ventilation drying through the dielectric and ventilation drying apparatus by using the carrier. In FIG. 1, a steam discharge duct is denoted by a numeral 116.

A drying carrier adapted for carrying honeycomb structures in the drying apparatus including the dielectric drying zone as mentioned above has been proposed by applicants (ref. Japanese Patent application Publication No. 60-37382). This drying carrier includes perforated plates having an area including a portion contacting with an open bottom surface of the honeycomb structure and a conductivity higher than that of the remaining portion of the drying carrier as shown in FIGS. 2 and 3. That is, the drying carrier 1 has a hole 2 having a dimension larger than the bottom surface of the honeycomb structure 3 to be carried and a perforated plate 4 made of a material having a conductivity higher than that of the carrier 1 is securely fitted in the hole 2. When the honeycomb structures are dried by use, of such a drying carrier, particularly during dielectric drying, the occurrence of cracks in the honeycomb structure is prevented in the subsequent sintering step. Thus, the proposed drying carrier is superior to the conventional drying carrier so that the quality and productivity of various honeycomb structures such as cordierite, mullite, silicon nitride and the like are improved.

However perforated plate 4 of the proposed drying carrier is flat and has an upper contacting surface area larger than that of the bottom surface of the honeycomb structure to be dried. Therefore, when the honeycomb structure shrinks during drying, the shrinkage of the bottom portion of the honeycomb structure is prevented because of a fractional resistance between the surfaces of the bottom of the honeycomb structure and the perforated plate. Consequently, the honeycomb structure is deformed to deteriorate the dimensional accuracy thereof so that the yield becomes low when a high dimensional accuracy is required. Furthermore, the fractional resistance causes a shrinkage strain to generate in the bottom surface of the honeycomb structure thus resulting in cracks in the bottom surface. Thus, the frictional resistance adversely affects the quality of the products.

SUMMARY OF THE INVENTION

An object of the invention is to provide a drying carrier for honeycomb structures capable of improving the quality of the honeycomb structure by preventing the dimensional deformation and cracks caused by the fractional resistance from occurring in the bottom surface of the honeycomb structure.

According to the invention, in a drying carrier comprising perforated plates made of a material having a conductivity higher than that of the drying carrier itself, the perforated plate has a convex shape in section to provide an upper contacting surface smaller than the bottom surface of a honeycomb structure to be carried.

With the above arrangement of the perforated plate, the area of the bottom surface of the honeycomb structure contacting the upper contacting surface of the perforated plate is smaller than that in the proposed drying carrier so that the friction resistance between the bottom surface of the honeycomb structure and the contacting surface of the perforated plate is reduced when the honeycomb structure shrinks in the step of drying and as a result dimensional deformations and cracks are prevented from occurring during the step of drying.

The present invention will be described in detail by referring to the accompanying drawings.

DESCRIPTION OF THE PREFERRED EMBODIMENTS

Figure 4:
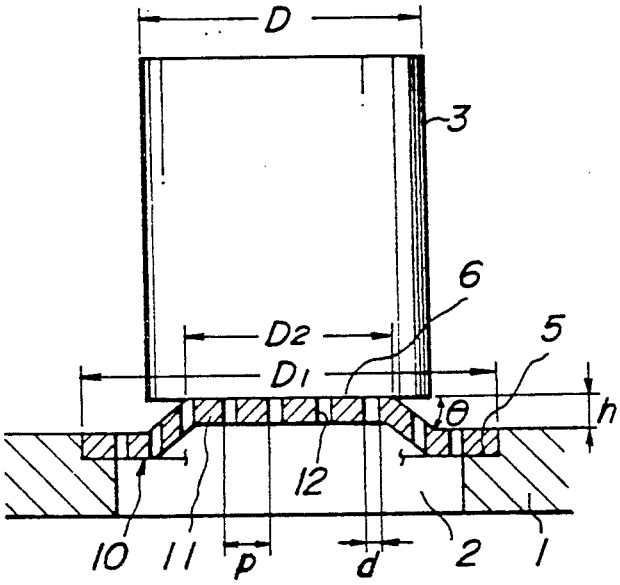
FIG. 4 is a sectional view illustrating an embodiment of a drying carrier according to the invention.

Referring to FIG. 4 illustrating an embodiment of the present invention, a perforated plate 10 is made of a material having a conductivity higher than that of a carrier 1 and is fitted in a shoulder 5 of a hole 2 formed in the carrier 1. The hole 2 in the carrier has a sectional area larger than that of the bottom of the honeycomb 3 to be carried. Therefore, the perforated plate 10 to be fitted in the hole 2 has a general dimension larger than the dimension of the bottom surface of the honeycomb structure 3, but the perforated plate 10 has a convex shape.

In the embodiment, the perforated plate 10 has a convex portion 11 formed at the central portion of the perforated plate so that the honeycomb structure is set on the upper contacting surface 6 of the convex portion.

The area (A) of the upper contacting surface 6 of the perforated plate 10 is smaller than the bottom surface area (B) of the honeycomb structure and is not less than 0.6 B.

The drying carrier is preferably made of plastic or other synthetic resins having a low conductivity, plasterboard or wood.

The perforated plate is preferably made of a material having a conductivity higher than that of the material of the carrier 1, for example aluminum, copper, aluminum alloy and a combination thereof.

Figure 1:
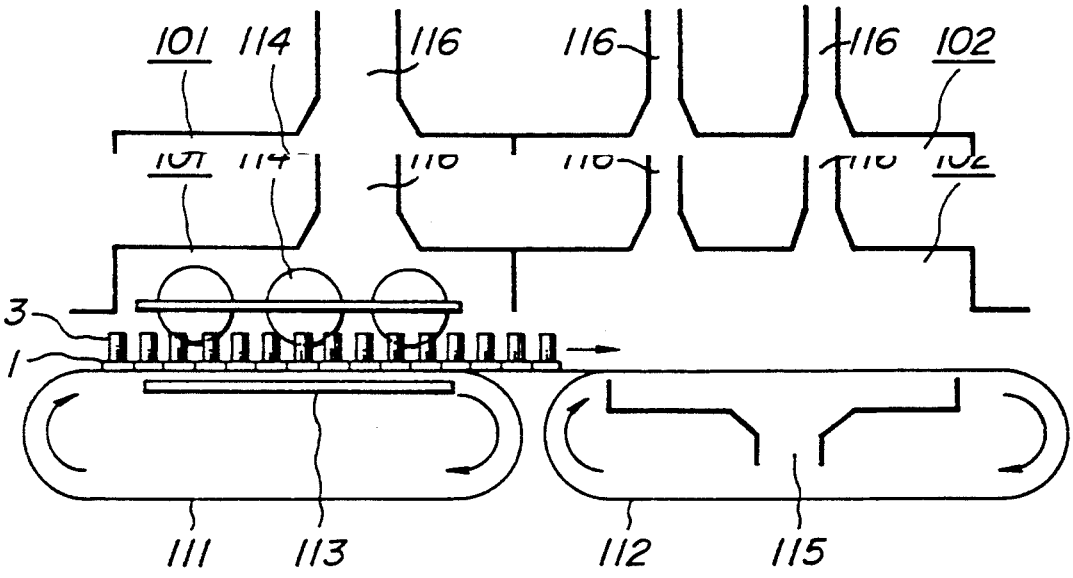
FIG. 1 PRIOR ART
FIG. 1 is a diagrammatic view of a dielectric and ventilation type drying apparatus.
Figure 2:
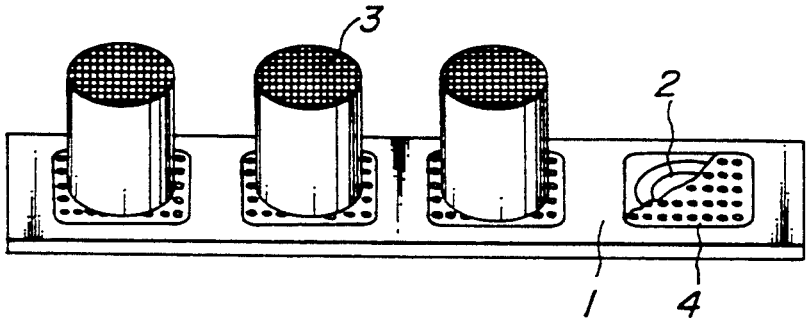
FIG 2 PRIOR ART
FIG. 2 is a perspective view illustrating an example of a drying carrier proposed by applicants prior to the present invention.
Figure 3:
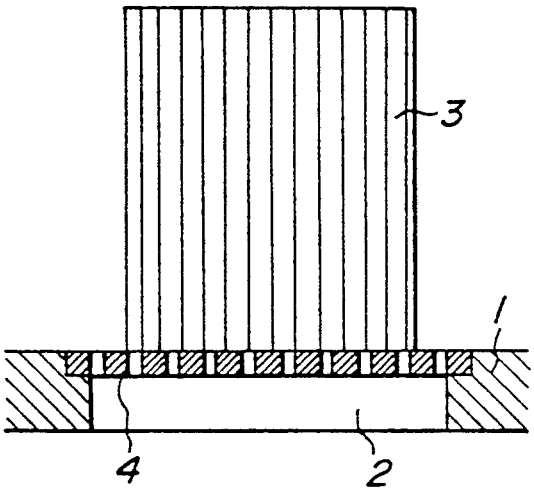
FIG 3 PRIOR ART
FIG. 3 is an enlarged sectional view of a product carried on the drying carrier shown in FIG. 2.

The perforated plate 10 has a number of apertures 12 as shown in FIG. 1 with an open percentage of 20~90%, preferably 40~80%. The shape of the aperture 12 in the perforated plate 10 may be circular, rectangular, slit-like and others.

If the open percentage of the perforated plate 10 is lower than 20%, steam generated from the bottom surface portion of the honeycomb structure 3 during the step of drying can not be sufficiently diffused and condenser between the perforated plate and the bottom surface of the honeycomb structure so that the bottom portion of the honeycomb structure is not completely dried. If the open percentage of the perforated plate exceeds 90%, the strength of the perforated plate becomes low to thereby deform the perforated plate so that the honeycomb structure 3 engages the perforated plate by own weight.

The apertures 12 may be its formed in the perforated plate 10 by punching as mentioned later. The convex portion 11 may be formed by pressing in the punching step.

The convex portion 11 has an upper contacting surface 6 having a surface area A smaller than the bottom surface area B of the honeycomb structure as mentioned above in a relationship of $0.6B \leqq A < B$, preferably $0.7B \leqq A < 0.9B$ and an angle $\theta$ is preferably in a range of 30°~60° . Furthermore, the height of the convex portion 11, that is the distance to the upper contacting surface 6 from the flat surface at the peripheral portion of the perforated plate 10 is in a range of 1 mm~5 mm, preferably 1.5 mm~2.5 mm.

If the upper contacting surface area (A) of the convex portion 11 is smaller than 0.6B, the honeycomb structure is easily deformed by its own weight so that when the structures are moved by a conveyor as shown in FIG. 1, the structures become unstable and then contact with each other to thereby be broken owing to a collision. If the upper contacting surface area A is larger than the bottom surface area B, all the bottom surface of the honeycomb structure contacts the upper contacting surface of the convex portion and as a result dimensional deformations or cracks can occur in the bottom portion of the honeycomb structure owing to the frictional resistance between the contacting surfaces.

Figure 5:
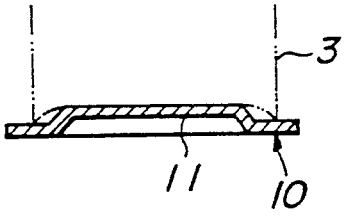
FIG. 5 is a diagrammatic view showing a relationship between a perforated plate and a product.

Furthermore, if the height of the convex portion 11 is less than 1 mm, the bottom peripheral portion of the honeycomb structure 3 may be easily contacted with the flat peripheral portion of the perforated plate 10 as shown in FIG. 5. When the bottom peripheral portion of the honeycomb structure 3 is contacted with the flat peripheral portion of the perforated plate 10, the effect of reducing the frictional resistance intended by providing the convex shape is nullified so that the occurrence of the dimensional deformation and cracks during the step of drying is not prevented. However, if the height of the convex portion 11 is more than 5 mm, the honeycomb structure set on the convex portion becomes unstable so that the honeycomb structures may be contacted with each other to thereby be broken by a collision as mentioned above. In particular, when the convex portion has the upper contacting surface area A smaller than 0.6B and the height higher than 5 mm, the honeycomb structure can be greatly deformed by its own weight and result in the occurrence of cracks.

The perforated plates 10 having the convex portion 11 formed according to the aforementioned conditions are fitted in holes formed in the carrier 1, respectively, and fixed with an adhesive having a low conductivity and a heat resistance, for example, for 150° C. corresponding to a predetermined ventilation temperature condition in the drying apparatus.

The drying carrier 1 provided with perforated plates 10 as shown in FIG. 4 can be used in the drying apparatus as shown in FIG. 1.

A preferred example of the material and dimensions of the carrier and perforated plates will be described by referring to FIG. 1.

The material of the carrier is wood, the material of the convex shaped perforated plate is aluminum, diameter $D_1$ is 146 and $D_2$ is 52 mm, the open percentage of the perforated plate is determined by the diameter (d) of the aperture 12 and a pitch (p) between apertures 12, for example, in the embodiment illustrated in FIG. 1, (d) is 5.5 mm, (p) is 7.0 mm and the open percentage is 48.5%. The honeycomb structure 3 set on upper contacting surface 16 of the convex portion 11 of the perforated plate 10 has a diameter (D) of 118 mm so that the contacting surface area (A) of the perforated plate 10 is 0.8 (B), B is the bottom surface area of the honeycomb structure to be dried, and the height (h) of the convex portion 11 is 2 mm.

Figure 6:
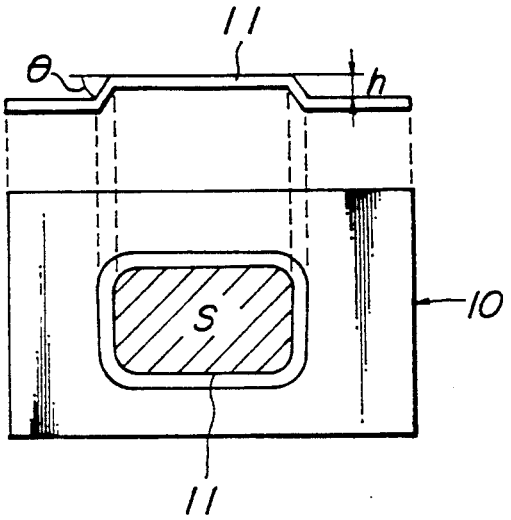
FIG. 6 is a diagrammatic view illustrating a sample used in a test.

In order to confirm the effect of the invention, a test was performed by using convex shaped perforated plates 10 as in FIG. 6 having various contacting surface areas (A), angles $\theta$, and heights (h) of the convex portions. The results of the test are shown in Table 1 together with a comparative prior art. In Table 1, the dimension difference is a difference (f) between diameters of upper and lower portions of each of honeycomb structures (products) shown in FIG. 7.

TABLE 1

| | Contacting area A | Angle θ° | Height $h_{mm}$ | Dimension difference mm | Bottom crack occurring % | Deformation owing to own weight |
|---|---|---|---|---|---|---|
| Example 1 | 0.8 B | 45 | 2 | 0.5 | 0 | ◎ |
| Example 2 | 0.5 B | 45 | 2 | 0.5 | 0 | X |
| Example 3 | 0.9 B | 45 | 2 | 0.5 | 0 | ◎ |
| Example 4 | 0.8 B | 45 | 1 | 0.9 | 20 | ◎ |
| Example 5 | 0.5 B | 40 | 5 | 0.7 | 15 | X |
| Example 6 | 0.6 B | 45 | 2 | 0.5 | 0 | ○ |
| Example 7 | 0.9 B | 60 | 2 | 0.5 | 0 | ◎ |
| Prior art | 1.0 B | 0 | — | 1.2 | 40 | ◎ |

It is seen from the results shown in Table 1 that according to the invention dimensional deformations and cracks caused by fractional resistance during the step of drying are greatly reduced or prevented in compared with the prior art wherein all the bottom surface of the honeycomb structure contacts the surface of the perforated plate without the convex portion.

In order to prevent undesirable electric discharge during the step of dielectric drying, the perforated plate in the drying carrier may be shaped as shown in FIGS. 8 and 9.

Figure 8A:
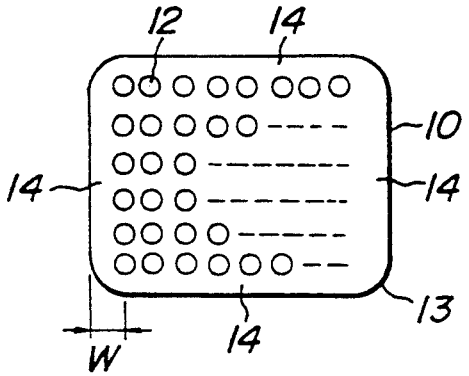
FIGS. 8*a* and 8*b* are diagrammatic views illustrating an embodiment of a perforated plate adapted for preventing electric discharge.

Referring to FIG. 8*a*, corners 13 of the perforated plate 10 are preferably curved by a radius of curvature (R) in a range of 5~15 mm. If the radius of curvature (R) is not more than 5 mm, the corner has an edge so that an electric charge concentrates in the edge during dielectric drying to cause an electric discharge.

Figure 8B:
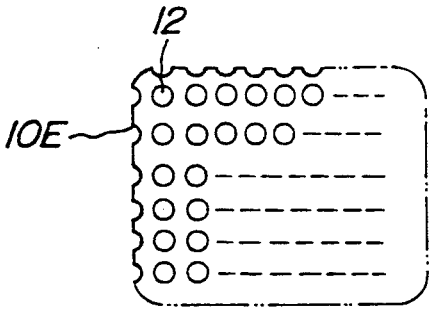

Furthermore, the perforated plate 10 is preferably provided with a peripheral portion 14 having a predetermined width (w). If the perforated plate 10 has no peripheral portion, as shown in FIG. 8*b*, edges 10E are formed when the apertures 12 are punched in the plate. Such an edge can result in electric charge concentration.

Figure 9A:
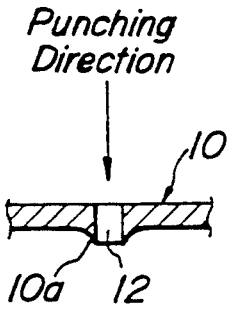
FIGS. 9*a* and 9*b* are diagrammatic views illustrating a perforated plate having an aperture formed by punching and a product set on the perforated plate.
Figure 9B:
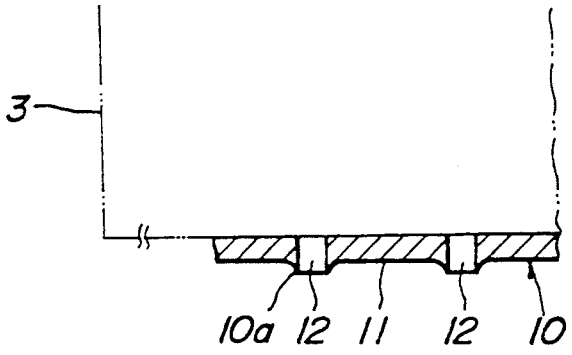

Referring to FIG. 9*a*, when the apertures 12 are punched in the plate, an edge 10*a* is formed on the opposite side of the plate to the punching direction. Therefore, the perforated plate 10 must be fixed to the drying carrier 1 in such a manner that the plate side formed with the edges 10*a* is the under side of the convex portion 11 of the perforated plate 10 on which the honeycomb structure 3 is set as shown in FIG. 9*b*. Thus, the electric discharge owing to the edges 10*a* is prevented and the frictional resistance is effectively reduced.

Figure 10A:
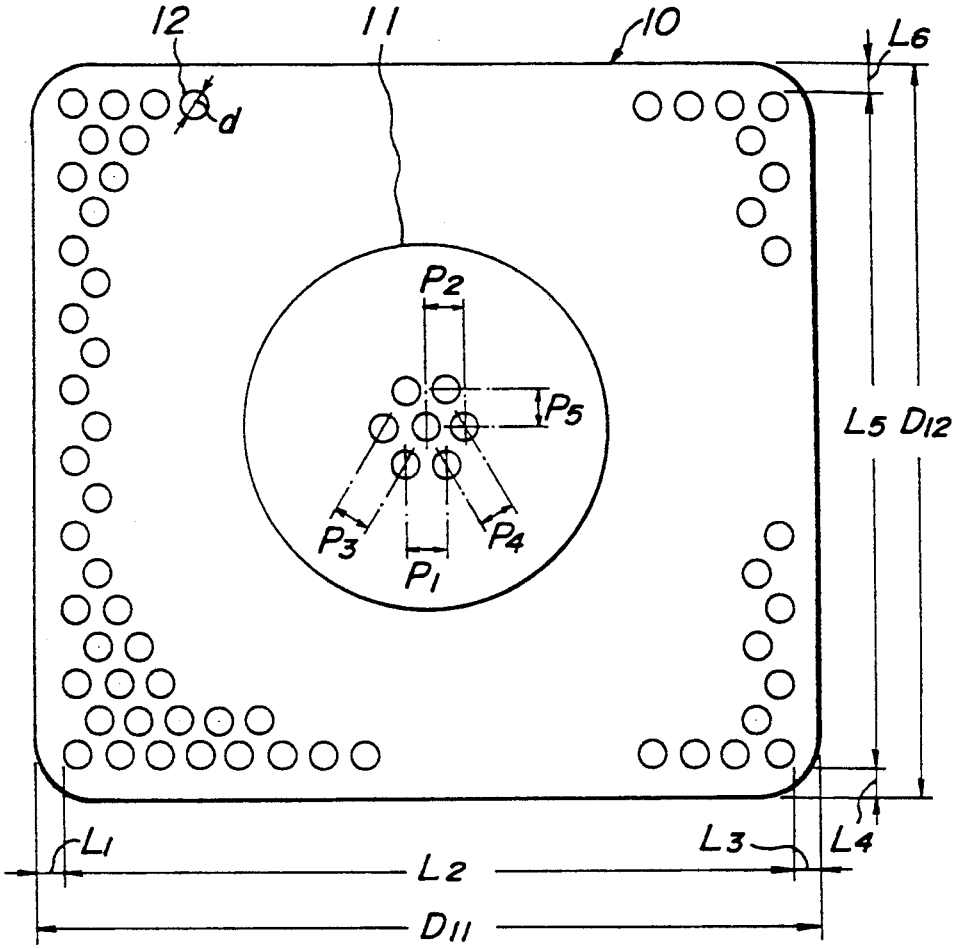
FIGS. 10*a* and 10*b* are diagrammatic views illustrating another embodiment of the perforated plate according to the invention.
Figure 10B:
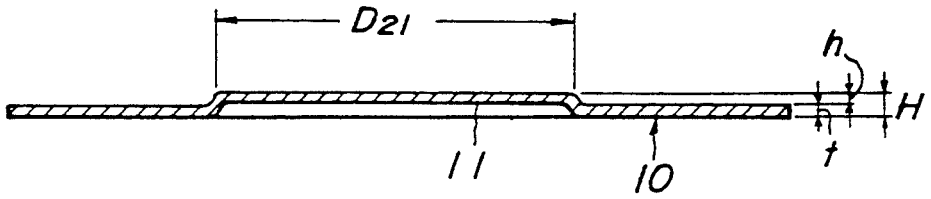
Figure 11:
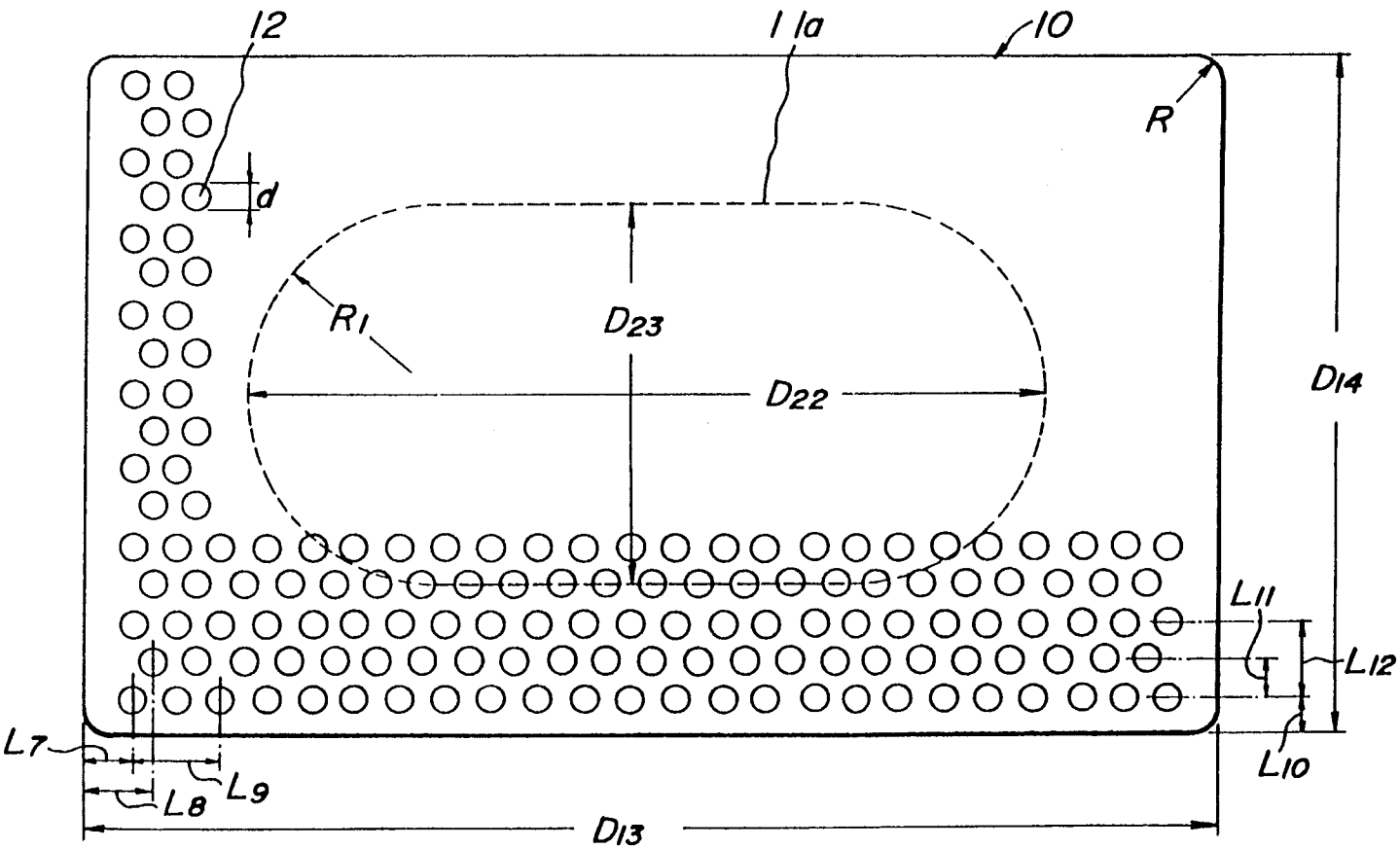
FIG. 11 is a diagrammatic view illustrating a further embodiment of the perforated plate.

FIGS. 10 and 11 illustrate other embodiments of the perforated plates 10 of the drying carrier. The perforated plates shown in FIGS. 10 and 11 are made of aluminum punched plates. In FIG. 10, the convex portion is formed with a height (h) of 3 mm by punching.

Figure 7:
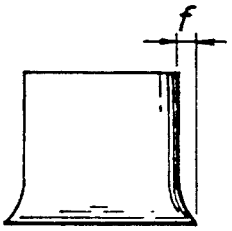
FIG. 7 is a diagrammatic view of a product.

The dimensions (mm) denoted in FIG. 7 are as follows:

$D_{11} = 142$ $D_{12} = 132$ $D_{21} = 85$ $L_1, L_3 = 4.5$ $L_2 = 133$ $L_4, L_6 = 4.75$ $L_5 = 117$ $t = 2,$ $h = 3,$ $H = 5$ $P_1, P_2 = 7.5$ $P_3, P_4, P_5 = 6.5$ $d = 5.5$ $R = 10$ ($R$ is a radius of curvature of corners)

The dimensions (mm) denoted in FIG. 11 are as follows.

$D_{13} = 188$ $D_{14} = 114$ $L_7 = 8$ $L_8 = 12$ $L_9 = 15$ $L_{10} = 5$ $L_{11} = 6.5$ $L_{12} = 13$ $d = 5.5$ $D_{22} = 122$ $D_{23} = 65$ $R = 10$ $R_1 = 28$

Moreover, a punched portion 11*a* has an oval shape which is similar to that shown in FIG. 6. In this embodiment, the perforated plate 10 has a similar peripheral portion of a width in a range of 2.2~7.5 mm, as shown in FIG. 10 in order to prevent the electric discharge caused by edge portions.

According to the present invention, the frictional resistance generated during the step of drying is reduced to prevent the occurrence of dimensional deformations and cracks, thereby improving the quality of the honeycomb structures.

What is claimed is:

1. In a drying apparatus for drying ceramic honeycomb structures comprising a drying carrier for carrying the honeycomb structures, said drying carrier comprising a plurality of perforated plates spaced apart from each other in the longitudinal direction of the drying carrier, said perforated plates comprising a material having a conductivity higher than that of the drying carrier, wherein the improvement comprises:

each of said perforated plates comprises a convex portion having an upper contacting surface directly contacting a bottom surface of the honeycomb structure.

2. The drying apparatus of claim 1, further comprising a dielectric drying zone and a ventilation drying zone.

3. The drying apparatus of claim 1, wherein the surface area of said upper contacting surface is smaller than the surface area of a bottom surface of the honeycomb structure.

4. The drying carrier of claim 3, wherein the surface area of said upper contacting surface is not less than 0.6 times the surface area of the bottom surface of the honeycomb structure.

5. The drying carrier of claim 1, wherein the material of the drying carrier is selected from the group consisting of low conductivity synthetic resins, plasterboard, and wood.

6. The drying carrier of claim 1, wherein the material of the drying carrier is low conductivity plastic.

7. The drying carrier of claim 1, wherein the material of the perforated plates is selected from the group consisting of aluminum, copper, aluminum alloy and combinations thereof.

8. The drying carrier of claim 1, wherein the perforated plates have an open percentage of 20~90%.

9. The drying carrier of claim 1, wherein the convex portion of the perforated plates has a height of 1~5 mm.

* * * * *